US011081257B2

(12) United States Patent
Kaczmarski et al.

(10) Patent No.: US 11,081,257 B2
(45) **Date of Patent: *Aug. 3, 2021**

(54) NOTCHED CONDUCTOR FOR TELECOMMUNICATION CABLE

(71) Applicant: Sterlite Technologies Limited, Gurgoan (IN)

(72) Inventors: Andrew Kaczmarski, Casula (AU); Darshana Bhatt, Aurangabad (IN); Aakar Shivankar, Aurangabad (IN); Aalap Shah, Aurangabad (IN)

(73) Assignee: STERLITE TECHNOLOGIES LIMITED, Gurgoan (IN)

( * ) Notice: Subject to any disclaimer, the term of this patent is extended or adjusted under 35 U.S.C. 154(b) by 0 days.

This patent is subject to a terminal disclaimer.

(21) Appl. No.: 16/701,440

(22) Filed: Dec. 3, 2019

(65) Prior Publication Data

US 2020/0105442 A1 Apr. 2, 2020

Related U.S. Application Data

(63) Continuation of application No. 16/224,732, filed on Dec. 18, 2018, now Pat. No. 10,535,449.

(30) Foreign Application Priority Data

Jan. 29, 2018 (IN) ..... 201811002209

(51) Int. Cl.

| | |
|---|---|
| ***H01B 11/06*** | (2006.01) |
| ***H01B 7/00*** | (2006.01) |
| *H01B 7/30* | (2006.01) |

(52) U.S. Cl.

CPC ..... *H01B 11/06* (2013.01); *H01B 7/0009* (2013.01); *H01B 7/30* (2013.01)

(58) Field of Classification Search

CPC ..... H01B 7/0823; H01B 15/006; H01B 7/14; H01B 11/1891; H01B 11/206;

(Continued)

(56) References Cited

U.S. PATENT DOCUMENTS 91,530 A * 6/1869 Farley ..... H01B 5/08 174/129 R
288,443 A * 11/1883 Johnson ..... H01B 7/0009 174/128.1

(Continued)

*Primary Examiner* — William H. Mayo, III
*Assistant Examiner* — Krystal Robinson

(57) ABSTRACT

The present disclosure relates to an insulated conductor for a telecommunications cable. The insulated conductor includes a first surface surrounding a core region of the notched conductor. The first surface defines a plurality of grooves extending radially inward towards the second longitudinal axis of the insulated conductor. Each of the plurality of grooves comprises of a first groove area section and a second groove area section. The first groove area section and the second groove area section are in continuous contact. The insulated conductor includes an insulation layer circumferentially surrounding the conductor. The insulated conductor has a first diameter in a range of about 0.5 millimeters to 0.65 millimeters. The telecommunications cable includes, plurality of twisted pairs of insulated conductors, a separator and a cable jacket.

20 Claims, 2 Drawing Sheets

(58) Field of Classification Search
CPC ..... H01B 11/22; H01B 7/184; H01B 7/426; H01R 12/67; H01R 13/5205; H01R 4/2404; H01R 12/675; H01R 13/73; H01R 33/06; H01R 4/2429; H01R 4/2466; H01R 9/05; H01R 13/72; H01R 2103/00; H01R 24/40; H01R 31/06; H01R 4/44; H01R 4/64; H01R 4/646; H01R 12/53; H01R 12/707; H01R 12/721; H01R 13/22; H01R 13/2442; H01R 13/5213; H01R 13/5216; H01R 13/5219; H01R 13/5825; H01R 13/6395; H01R 13/64; H01R 13/648; H01R 13/6683; H01R 13/6691; H01R 2107/00; H01R 25/142; H01R 43/28; H01R 4/027; H01R 9/0509
See application file for complete search history.

(56) References Cited

U.S. PATENT DOCUMENTS 543,960 A * 8/1895 Gray ..... C23C 28/02 174/133 R
2,149,772 A * 3/1939 Vassar ..... H01B 9/006 174/26 R
2,314,798 A * 3/1943 Peterson ..... D07B 1/147 174/128.1
2,583,025 A * 1/1952 Swift ..... H01B 7/182 174/117 R
3,864,508 A * 2/1975 Beck ..... H01B 12/06 174/15.5
4,101,731 A * 7/1978 Marancik ..... H01L 39/14 174/125.1
4,463,219 A * 7/1984 Sato ..... H01B 5/02 174/127
4,683,349 A * 7/1987 Takebe ..... H01B 7/06 174/113 C
5,696,352 A * 12/1997 Kourimsky ..... H01R 4/58 174/126.3
6,967,289 B2 * 11/2005 Goto ..... H01B 7/0009 174/129 R
7,479,597 B1 * 1/2009 Cases ..... H01B 7/0009 174/115
8,399,763 B2 * 3/2013 Horiike ..... H01B 7/0009 174/36
9,070,493 B2 * 6/2015 Hsu ..... G06F 30/00
2003/0178224 A1 * 9/2003 Goto ..... H01B 7/0009 174/133 R
2004/0168821 A1 * 9/2004 Goto ..... H01B 7/30 174/133 R
2007/0277996 A1 * 12/2007 Caveney ..... H01B 7/0009 174/129 R
2009/0266132 A1 * 10/2009 McDonald ..... B21C 37/045 72/235

* cited by examiner

NOTCHED CONDUCTOR FOR TELECOMMUNICATION CABLE

FIELD OF THE INVENTION

The present disclosure, relates to the field of telecommunication cables. More particularly, the present disclosure relates to a notched conductor for a twisted pair telecommunication cable. The present application is based on, and claims priority from U.S. application Ser. No. 16/224,732 filed on 18 Dec. 2018, which claims priority from an Indian application No. 201811002209 filed on Jan. 29, 2018 the disclosure of which is hereby incorporated by reference herein.

DESCRIPTION OF PRIOR ART

With an increase in utilization of complex communication and networking systems, the demand for transmitting signals at high transmission rates has increased. In order to meet the growing demands, various types of telecommunication cables are used for transmitting signals which are compliant with high-performance data standards. These telecommunication cables are classified into Category 5, Category 6 and Category 7 based on the signal transmission characteristics. Also, these telecommunication cables are classified into UTP (Unshielded Twisted Pair) cables, FTP (Foiled Twisted Pair) cables and STP (Shielded Twisted Pair) cables based on the shielding. Among these, a telecommunication cable is the widely used telecommunication cable in which one or more twisted pairs of insulated conductors are bundled within an outer jacket.

The telecommunication cable has one or more signal transmission and loss characteristics like insertion loss, return loss, propagation delay and input impedance. Out of these, the insertion loss is one of the major characteristics of the telecommunication cable. The insertion loss measures an amount of energy lost as the signal is transmitted across the telecommunication cable. The insertion loss of the telecommunication cable increases with the frequency of the signal to be transmitted. In addition, the insertion loss in the telecommunication cables occurs majorly due to skin effect. In general, the skin effect is the tendency of an electric current to distribute itself within a conductor so that the electric current density near the conductor's surface is greater than that at its core. The skin effect causes an effective resistance of the conductor to increase with the frequency of the electric current resulting in high insertion loss. Presently, several attempts are made to deal with the skin effect. One such attempt involves plating of the conductor with noble metals. Another such attempt involves an increment in cross-sectional diameter of the conductor for providing a larger surface area over which the electric current can flow. However, these attempts have several drawbacks. These attempts are expensive. In addition, these attempts produce bulky cables with low effective conductor area utilization at the high frequency. Moreover, these attempts are unable to make efficient use of the conductor.

In light of the above stated discussion, there exists a need for a telecommunications cable which overcomes the above cited drawbacks of conventionally known telecommunications cable.

SUMMARY OF THE INVENTION

The present disclosure relates to an insulated conductor for use in a telecommunications cable. The insulated conductor includes a notched conductor extending along a first longitudinal axis passing through a geometrical center of the telecommunications cable. The notched conductor includes a first surface surrounding a core region of the notched conductor. The first surface defines a plurality of grooves extending radially inward towards a second longitudinal axis of the insulated conductor. Each of the plurality of grooves comprises of a first groove area section and a second groove area section. The first groove area section being in continuous contact with the second groove area section. The first groove area section has first pointed end and the second groove area section has second pointed end. The plurality of grooves are characterized by a first circumferential arc length. The first circumferential arc length between two consecutive grooves of the plurality of grooves being in a range of about 0.1 millimeter to 1.5 millimeter. A first radial thickness T1 between the first surface and the first pointed end or the second pointed end of the plurality of grooves is in a range of about 10 microns to 50 microns. A second circumferential arc length between the pointed end of the first groove area section and the pointed end of second groove area section being in a range of about 2 microns to 50 microns. The insulated conductor includes an insulation layer circumferentially surrounding the notched conductor, wherein the insulation layer comprises of a second surface. A second radial thickness between the first surface and the second surface being in a range of about 0.15 millimeter to 0.4 millimeter. A third radial thickness between the second surface and the pointed end of the plurality of groove being in a range of about 160 microns to 450 microns. The conductor has a first diameter in a range of about 0.5 millimeters to 0.65 millimeters. The insulated conductor has a second diameter in a range of about 0.8 millimeters to 1.5 millimeters. The first diameter is distance between diametrically opposite pointed ends of the plurality of grooves. D2 is diameter of the second surface.

A primary object of the disclosure is to provide a notched conductor for telecommunication cables.

Another object of the present disclosure is to provide the conductor with increased current carrying capacity.

Yet another object of the present disclosure is to provide the telecommunication cable with reduced alien cross talk.

Yet another object of the present disclosure is to provide the telecommunication cable with reduced conductor material consumption.

Yet another object of the present disclosure is to provide the telecommunication cable with improved electrical performance.

Yet another embodiment of the present disclosure is to provide the telecommunication cable with improved transmission characteristics.

Yet another embodiment of the present disclosure is to provide the telecommunication cable with improved insertion loss.

In an aspect, the present disclosure provides an insulated conductor for use in a telecommunications cable. The insulated conductor includes a notched conductor extending along a first longitudinal axis passing through a geometrical center of the telecommunications cable. The notched conductor includes a first surface surrounding a core region of the notched conductor. The first surface defines a plurality of grooves extending radially inward towards a second longitudinal axis of the insulated conductor. Each of the plurality of grooves comprises of a first groove area section and a second groove area section. The first groove area section being in continuous contact with the second groove area section. The first groove area section has a first pointed end and the second groove area section has a second pointed end. The plurality of grooves are characterized by a first circumferential arc length. The first circumferential arc length between two consecutive grooves of the plurality of grooves being in a range of about 0.1 millimeter to 1.5 millimeter. A first radial thickness between the first surface and the first pointed end or the second pointed end of the plurality of grooves is in a range of about 10 microns to 50 microns. A second circumferential arc length between the pointed end of the first groove area section and the pointed end of second groove area section being in a range of about 2 microns to 50 microns. The insulated conductor includes an insulation layer circumferentially surrounding the notched conductor, wherein the insulation layer comprises of a second surface. A second radial thickness between the first surface and the second surface being in a range of about 0.15 millimeter to 0.4 millimeter. A third radial thickness between the second surface and the pointed end of the plurality of groove being in a range of about 160 microns to 450 microns. The insulated conductor has a first diameter in a range of about 0.5 millimeters to 0.65 millimeters. The insulated conductor has a second diameter in a range of about 0.8 millimeters to 1.5 millimeters. The first diameter is distance between diametrically opposite pointed ends of the plurality of grooves.

In an embodiment of the present disclosure, the plurality of grooves arranged around the first surface of the insulated conductor is between 3 to 12.

In an embodiment of the present disclosure, the plurality grooves being distributed uniformly around the first surface.

In another aspect, the present disclosure provides a telecommunications cable. The telecommunications cable includes a plurality of twisted pairs of insulated conductors. The plurality of twisted pairs of insulated conductors extends substantially along a first longitudinal axis of the telecommunications cable. Each of the plurality of twisted pairs of insulated conductors includes a plurality of insulated conductors. Each of the plurality of insulated conductor includes a notched conductor extending along the first longitudinal axis of the telecommunications cable. The notched conductor includes a first surface surrounding a core region of the insulated conductor. The first surface defines a plurality of grooves extending radially inward towards a second longitudinal axis of the insulated conductor. Each of the plurality of grooves comprises of a first groove area section and a second groove area section. The first groove area section being in continuous contact with the second groove area section. The first groove area section has first pointed end and the second groove area section has second pointed end. The plurality of grooves are characterized by a first circumferential arc length. The first circumferential arc length between two consecutive grooves of the plurality of grooves being in a range of about 0.1 millimeter to 1.5 millimeter. A first radial thickness between the first surface and the first pointed end or the second pointed end of the plurality of grooves is in a range of about 10 microns to 50 microns. A second circumferential arc length between the pointed end of the first groove area section and the pointed end of second groove area section being in a range of about 2 microns to 50 microns. The insulated conductor includes an insulation layer circumferentially surrounding the notched conductor, wherein the insulation layer comprises of a second surface. A second radial thickness between the first surface and the second surface being in a range of about 0.15 millimeter to 0.4 millimeter. A third radial thickness between the second surface and the pointed end of the plurality of groove being in a range of about 160 microns to 450 microns. The insulated conductor has a first diameter in a range of about 0.5 millimeters to 0.65 millimeters. The insulated conductor has a second diameter in a range of about 0.8 millimeters to 1.5 millimeters. 202 new is distance between diametrically opposite pointed ends of the plurality of grooves. D2 is diameter of the second surface. The telecommunications cable includes at least one separator for separating each twisted pair of insulated conductor of the plurality of twisted pairs of insulated conductors. The separator extends along the first longitudinal axis of the telecommunications cable. The telecommunications cable includes a cable jacket extending along the first longitudinal axis of the telecommunications cable. The cable jacket circumferentially surrounds a core region of the telecommunications cable. The telecommunications cable has a third diameter in a range of about 4 millimeters to 8 millimeters. The telecommunications cable has a fourth diameter in a range of about 5 millimeters to 9 millimeters.

In an embodiment of the present disclosure the telecommunications cable includes a ripcord placed inside the core of the telecommunications cable and lying substantially along the first longitudinal axis of the telecommunications cable, wherein the ripcord facilitate stripping of the cable jacket.

In an embodiment of the present disclosure, the insulation layer is made of a material selected from a group consisting of polyolefin, polypropylene, foamed polyolefin, foamed polypropylene and fluoro-polymer.

In an embodiment of the present disclosure, the separator is made of a material selected from a group consisting of foamed polyolefin, polyolefin, polyethene, solid or foamed polypropylene, LSZH and flame retardant polyvinyl chloride.

BRIEF DESCRIPTION OF DRAWING

Figure 1:
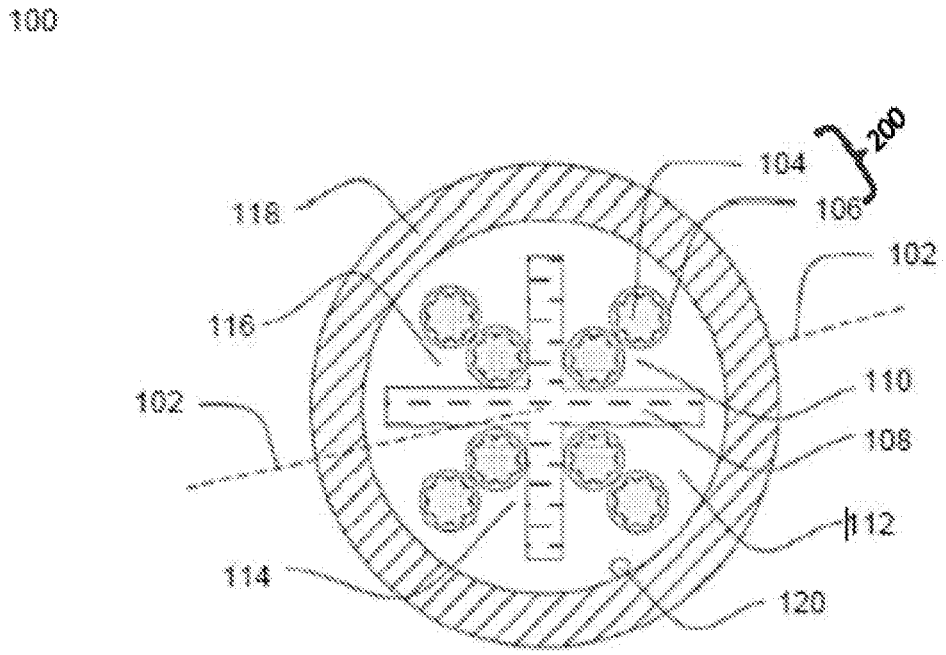
Figure 2:
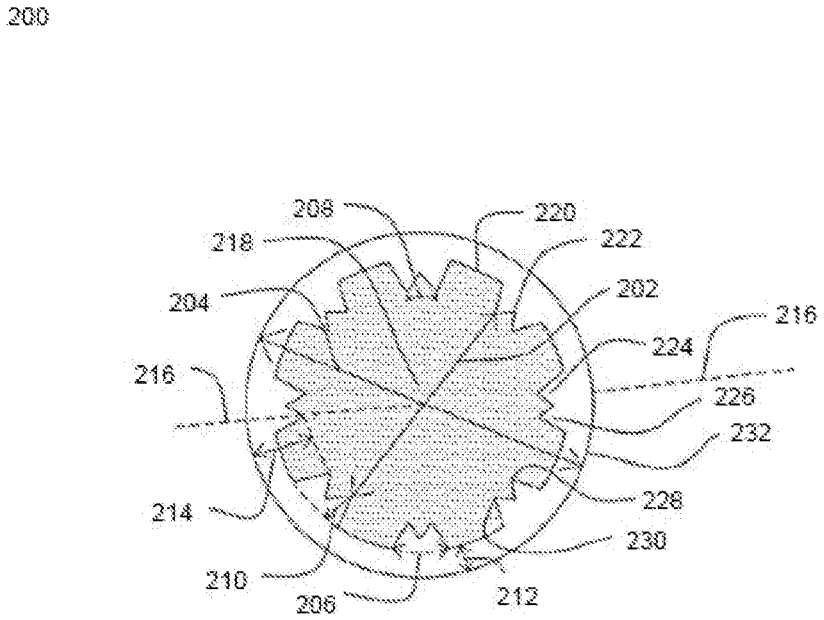

Having thus described the disclosure in general, terms, reference will now be made to the accompanying figures, wherein:

FIG. 1 illustrates a cross sectional view of a telecommunication cable, in accordance with an embodiment of the present disclosure; and FIG. 2 illustrates a cross sectional view of an insulated conductor, in accordance with an embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

REFERENCE NUMERALS IN THE DRAWINGS

For a more complete understanding of the present invention parts, reference is now made to the following descriptions:

100—The telecommunications cable.
102—The first longitudinal axis.
104—Notched conductor.
106—Insulation layer.
108—Separator.
110—The first area section.
112—The second area section.
114—The third area section.
116—The fourth area section.
118—Cable jacket.

120—Ripcords.
200—Insulated conductor.
202—The first diameter.
204—The second diameter.
206—The first circumferential arc length.
208—The second circumferential arc length.
210—The first radial thickness.
212—The second radial thickness.
214—The third radial thickness.
216—The second longitudinal axis.
218—Core region.
220—The first surface.
222—Plurality of grooves.
224—The first groove area section.
226—The second groove area section.
228—The first pointed end.
230—The second pointed end.
232—The second surface.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Reference will now be made in detail to selected embodiments of the present disclosure in conjunction with accompanying figures. The embodiments described herein are not intended to limit the scope of the disclosure and the present disclosure should not be construed as limited to the embodiments described. This disclosure may be embodied in different forms without departing from the scope and spirit of the disclosure. It should be understood that the accompanying figures are intended and provided to illustrate embodiments of the disclosure, described below and are not necessarily drawn to scale. In the drawings, like numbers refer to like elements throughout, and thicknesses and dimensions of some components may be exaggerated for providing better clarity and ease of understanding.

It should be noted that the terms "first", "second", and the like, herein do not denote any order, ranking, quantity, or importance, but rather are used to distinguish one element from another. Further, the terms "a" and "an" herein do not denote a limitation of quantity, but rather denote the presence of at least one of the referenced item.

FIG. 1 illustrates a cross sectional view of a telecommunications cable 100, in accordance with an embodiment of the present disclosure. In general, the telecommunications cable 100 is a media that allows baseband transmissions from a transmitter to a receiver. The telecommunications cable 100 is used for a wide variety of applications. The wide variety of applications include recording studios, data transmission, radio transmitters, intercoms, electronic circuit installations and the like. Moreover, the telecommunications cable 100 is used for high speed data rate transmission. The high speed data rate transmission includes 1000BASE-T (Gigabit Ethernet) and 10 GBASE-T (10-Gigabit Ethernet) or other standards. The telecommunications cable 100 is a shielded or unshielded twisted pair telecommunications cable. In general, the unshielded twisted pair telecommunications cable is a cable with two conductors of a single circuit twisted together. The insulated conductors are twisted together for the purposes of canceling out electromagnetic interference from external sources. The telecommunications cable 100 is associated with a first longitudinal axis 102. The first longitudinal axis 102 of the telecommunications cable 100 passes through a geometrical center of the cross section of the telecommunications cable 100.

Further, the telecommunications cable 100 includes a plurality of twisted pairs of insulated conductors, a separator 108, plurality of area sections 110-116 and a cable jacket 118. In addition, the telecommunications cable 100 may include a ripcord 120. In addition, the plurality of twisted pairs of insulated conductors includes more pairs of twisted insulated conductors. The above combination of structural elements enables an improvement in a plurality of characteristics of the telecommunications cable 100. The plurality of characteristics includes electrical properties and transmission characteristics. The electrical properties include input impedance, conductor resistance, mutual capacitance, resistance unbalance, capacitance unbalance, propagation delay and delay skew. The transmission characteristics include attenuation, return loss, near end crosstalk, attenuation to crosstalk ratio far end, alien cross talk, power sum attenuation to crosstalk ratio at far end and Transverse Conversion Loss (TCL).

In general, the input impedance is the ratio of the amplitudes of voltage and current of a wave travelling in one direction in the absence of reflections in the other direction. In an embodiment of the present disclosure, the input impedance of the telecommunications cable 100 is 100 ohm±15 ohm. In another embodiment of the present disclosure, the telecommunications cable 100 has any other suitable value of characteristic impedance. In general, the conductor Resistance is an electrical quantity that measures how the device or material reduces the electric current flow through it. In an embodiment of the present disclosure, the conductor resistance of the telecommunications cable 100 is less than or equal to 9.38 ohm per 100 meters at 20° C. In another embodiment of the present disclosure, the telecommunications cable 100 has any other suitable value of the conductor resistance.

In general, the mutual capacitance is intentional or unintentional capacitance taking place between two charge-holding objects or conductors in which the current passing through one passes over into the other conductor. In an embodiment of the present disclosure, the mutual capacitance of the telecommunications cable 100 is less than 5.6 nanoFarads per 100 meters at 1000 Hz. In another embodiment of the present disclosure, the telecommunications cable 100 has any other suitable value of the mutual capacitance. In general, the resistance unbalance is a measure of the difference in resistance between two conductors in a cabling system. In an embodiment of the present disclosure, the telecommunications cable 100 has the resistance unbalance of maximum 5 percent. In another embodiment of the present disclosure, the telecommunications cable 100 has any other suitable value of the resistance unbalance.

In general, the capacitance unbalance is a measure of difference in capacitance between two conductors in a cabling system. In an embodiment of the present disclosure, the capacitance unbalance of the telecommunications cable 100 is 330 picoFarads per 100 meter at 1000 Hz. In another embodiment of the present disclosure, the telecommunications cable 100 has any other suitable value of capacitance unbalance. In general, the propagation delay is equivalent to an amount of time that passes between when a signal is transmitted and when it is received on the other end of a cabling channel Propagation delay is 570 ns per 100 meters at 1 MHz. In general, the delay skew is a difference in propagation delay between any two conductor pairs within the same cable. In an embodiment of the present disclosure, the delay skew of the telecommunications cable 100 is less than 45 nanoseconds per 100 meters at 1 MHz. In another embodiment of the present disclosure, the telecommunications cable 100 has any other suitable value of the delay skew.

The telecommunications cable 100 enables increase in data transmission speed at high frequency. In general, the speed at which data is transmitted across a communication channel is referred to as data transmission speed. In general, the return loss is the measurement (in decibel) of the amount of signal that is reflected back toward the transmitter. In an embodiment of the present disclosure, the return loss of the telecommunications cable 100 is 20 dB at 1 MHz. In another embodiment of the present disclosure, the telecommunications cable 100 has any other suitable value of the return loss. In general, the insertion loss is the loss of signal power resulting from the material loss and is usually expressed in decibels. In an embodiment of the present disclosure, the telecommunications cable 100 has an insertion loss of 2.08 dB at a frequency of 1 MHz at 20° C. In another embodiment of the present disclosure, the telecommunications cable 100 has any other suitable value of insertion loss.

In general, the propagation delay is equivalent to an amount of time that passes between when a signal is transmitted and when it is received on the other end of a cabling channel. In an embodiment of the present disclosure, the propagation delay for the telecommunications cable 100 is 570 nanoseconds at a frequency of 1 MHz. In another embodiment of the present disclosure the telecommunications cable 100 has any other suitable value of propagation delay. In general, the alien crosstalk is electromagnetic noise occurring in a telecommunications cable 100 running alongside one or more other signal-carrying cables. The term "alien" is used as alien crosstalk occurs between different cables in a group or bundle and not between individual wires or circuits within a single cable. In an embodiment of the present disclosure, the telecommunications cable 100 has an Power Sum alien Near End cross talk of 67 dB at a frequency of about 1 MHz. In another embodiment of the present disclosure, the telecommunications cable 100 has any other suitable value of alien cross talk. In general, crosstalk is an error condition describing the occurrence of a signal from one wire pair radiating to and interfering with the signal of another wire pair. In general, the input impedance is the ratio of the amplitudes of voltage and current of a wave travelling in one direction in the absence of reflections in the other direction. In an embodiment of the present disclosure, the input impedance of the telecommunications cable 100 is 100 ohms±15 ohm. In another embodiment of the present disclosure, the telecommunications cable 100 has any other suitable value of input impedance.

Each of the plurality of twisted pairs of insulated conductors extends substantially along the first longitudinal axis 102 of the telecommunications cable 100. In an embodiment of the present disclosure, each of the plurality of twisted pairs of insulated conductors is helically twisted along a length of the plurality of twisted pairs of insulated conductors. The plurality of twisted pairs of insulated conductors are helically twisted together to minimize the cross talk in the telecommunications cable 100. In an embodiment of the present disclosure, a number of the plurality of twisted pairs of insulated conductors is 4. In another embodiment of the present disclosure, the number of the plurality of twisted pairs of insulated conductors may vary. Each of the four twisted pair of insulated conductor includes two insulated conductors twisted together along a length of the insulated conductors.

The telecommunications cable 100 includes a plurality of twisted pairs of insulated conductors. Each twisted pair of insulated conductor includes a first insulated conductor and a second insulated conductor. In addition, each insulated conductor of the plurality of twisted pairs of insulated conductors includes an insulated conductor and an insulation layer. The first insulated conductor is surrounded by a first insulation layer. The second insulated conductor is surrounded by a second insulation layer. Similarly, each of the four twisted pair conductors includes a first insulated conductor surrounded by a first insulation layer and a second insulated conductor surrounded by a second insulation layer. Each of the plurality of twisted pairs of insulated conductors has the same structure. In general, a conductor is an object or material that allows the flow of electrical current in one or more directions. In general, insulation layer are employed in electrical conductors to support and separate electrical conductors, and without allowing electrical current to pass through insulation layer. The insulation layer facilitate to bulk wrap electrical conductors to enable electrical isolation. Each conductor is 22, 23 or 24 American wire gauge (hereinafter AWG) conductor. In general, AWG is a standardized wire gauge system. The value of wire gauge indicates the diameter of the conductors in the cable. The above mentioned characteristics values of the telecommunications cable 100 is for the telecommunications cable 100 up to category 6A. The characteristic values of telecommunications cable 100 will vary for higher category cable.

The telecommunications cable 100 includes a plurality of insulated conductors 200. The plurality of insulated conductors 200 extends substantially along the first longitudinal axis 102 of the telecommunications cable 100. Each of the plurality of insulated conductors 200 includes one notched conductor 104 and an insulation layer 106. The telecommunications cable 100 includes a plurality of notched conductors 104. The plurality of notched conductors 104 extends substantially along the first longitudinal axis 102 of the telecommunications cable 100. The plurality of notched conductors 104 are data transmission elements of the telecommunications cable 100. In general, conductors are used in many categories of data transmission, telecommunication, electrical wiring, power generation, power transmission, power distribution, electronic circuitry, and the like. Each of the plurality of notched conductors 104 is made of copper. In an embodiment of the present disclosure, the plurality of notched conductors 104 is made of any other suitable material. Each of the plurality of notched conductors 104 is identical in shape and size. The geometry of each of the plurality of notched conductors 104 is identical. Also, each of the plurality of insulated conductor 200 is identical in shape and size. The geometry of each of the plurality of insulated conductor 200 is identical. The geometry of each of the plurality of insulated conductors 200 is explained in detail in FIG. 2.

Referring to FIG. 2, the insulated conductor 200 includes the notched conductor 104. The notched conductor 104 includes a core region 218. In addition, the notched conductor 104 includes first surface 220, a plurality of grooves 222, first groove area section 224 and second groove area section 226. The first surface 220 surrounds the core region 218 of the notched conductor 104. In addition the insulated conductor 200 includes the insulation layer 106 and a second surface 232. The above combination of designing elements enables an improvement in a plurality of parameters of the insulated conductor 200. The plurality of parameters includes transmission parameters, electrical parameter, mechanical parameters, data transmission speed, return loss, insertion loss, propagation delay, crosstalk, alien cross talk, input impedance, and the like.

The insulated conductor 200 includes the notched conductor 104. In general, notched conductor has a greater outer surface area and thereby a greater current carrying capacity as compared to an ordinary conductor. The insulated conductor 200 is associated with a second longitudinal axis 216. The second longitudinal axis 216 of the insulated conductor 200 passes through the geometrical center of the notched conductor 104. The second longitudinal axis 216 of the insulated conductor 200 lies substantially parallel to the first longitudinal axis 102 of the telecommunications cable 100. The insulated conductor 200 includes the first surface 220. The first surface 220 surrounds the core region 218 of the notched conductor 104. The first surface 220 is outer surface of the notched conductor 104. The first surface 220 lies substantially along the second longitudinal axis 216 of the insulated conductor 200. The first surface 220 is substantially centered on the second longitudinal axis 216 of the insulated conductor 200. The first surface 220 is substantially circular in cross-section. The first surface 220 is of discontinuous circular cross section.

The first surface 220 includes the plurality of grooves 222. In general, groove refers to a portion in a body created by pressure, infiltration, notching, and destruction or simply by removing material from a site. In general, grooves increase outer surface area of conductor thereby increasing the current carrying capacity of conductor. The plurality of grooves 222 in the insulated conductor 200 are set up by notching a portion of material from body of the conductor 104. The plurality of grooves 222 refers to cavities formed by removing material from body of conductor 104. The plurality of grooves 222 extend radially inwards towards the second longitudinal axis 216 of the insulated conductor 200. The plurality of grooves 222 are continuing radially inwards towards the second longitudinal axis 216. The plurality of grooves 222 are formed with the facilitation of a manufacturing tool. The manufacturing tool has a particular shape. The particular shape of the manufacturing tool is corresponding to the shape of the plurality of grooves 222. The manufacturing tool notches material from cylindrical conductor to provide the notched conductor 104. The manufacturing tool notches material in particular shape to form the plurality of grooves 222. In an embodiment of the present disclosure, the plurality of grooves 222 is formed by any suitable mechanism. The plurality of grooves 222 lies substantially along the second longitudinal axis 216 of the insulated conductor 200. Each of the plurality of grooves 222 is substantially identical in cross section along the entire length of the insulated conductor 200.

Each of the plurality of grooves 222 has a cross-sectional shape selected from a group A. The group A includes M-shape. In an embodiment of the present disclosure, the group A includes sinusoidal, semicircular, square, rectangular, triangular, trapezoidal and arched. In another embodiment of the present disclosure, each of the plurality of grooves 222 has a cross sectional shape made from a combination of two or more shapes. In yet another embodiment of the present disclosure, the group includes any other suitable shapes of the like. In yet another embodiment of the present disclosure, each of the plurality of grooves 222 has any other suitable shape of the like.

The number of plurality of grooves 222 arranged around the first surface 220 of the notched conductor 104 is between 3 grooves to 12 grooves. In an embodiment of the present disclosure, the first surface 220 includes any other suitable number of the plurality of grooves 222. On increasing the number of plurality of grooves 222 in the first surface 220, the external surface area of the notched conductor 104 increases.

In an embodiment of the present disclosure, each of the plurality of grooves 222 is intruded up to different heights. The plurality of grooves 222 are distributed uniformly around the first surface 220. The cross sectional area of each of the plurality of groove 222 is identical. The distance between two consecutive grooves of the plurality of grooves 222 is identical. Each of the plurality of grooves 222 is intruded up to a same height towards the second longitudinal axis 216 of the insulated conductor 200. The pluralities of grooves 222 are equally distant from the second longitudinal axis 216 of the insulated conductor 200. For example, four identical grooves are distributed uniformly around circumference of a circle by placing them at the ends of two diameters of the circle, when the diameters of the circle intersect each other at right angle. In an embodiment of the present disclosure, the plurality of grooves 222 is arranged in any other suitable pattern around the first surface 220.

The shape and size of each of the plurality of grooves 222 is identical. In an embodiment of the present disclosure, the shape and size of each of the plurality of groove 222 may vary. The interstitial distance between two adjacent grooves of the plurality of grooves 222 is identical throughout the entire length of the insulated conductor 200. The plurality of grooves 222 are characterized by a first circumferential arc length 206. The first circumferential arc length 206 is the distance between two consecutive grooves of the plurality of groves 222. The first circumferential arc length 206 lie in a range of about 0.1 millimeters to 1.5 millimeters. In an embodiment of the present disclosure, the first circumferential arc length 206 lies in any other suitable range of the like.

Further, each groove of the plurality of grooves 222 further includes first groove area section 224 and the second groove area section 226. The first groove area section 224 is in continuous contact with the second groove area section 226. The first groove area section 224 is identical in shape and size to the second groove area section 226. The first groove area section 224 is mirror image of the second groove area section 226. Each of the first groove area section 224 has a first pointed end 228. Each of the second groove area section 226 has a second pointed end 230. The first pointed end 228 of the first grove area section 224 and the second pointed end 230 of the second groove area section 226 is toward the second longitudinal axis 216 of the insulated conductor 200. The first pointed end 228 of the first groove area section 224 and the second pointed end 230 of the second groove area section 226 are equidistant from the second longitudinal axis 216 of the insulated conductor 200. The plurality of grooves 222 are characterized by a first radial thickness 210. The first radial thickness 210 is the radial distance between the first surface 220 and first pointed end 228 or the second pointed end 230 of each of the plurality of grooves 222. The first radial thickness 210 between the first surface 220 and the first pointed end 228 or the second pointed end 230 of each of the plurality of grooves 222 is in a range of about 10 microns and 50 microns. In an embodiment of the present disclosure, the first radial thickness 210 between the first surface 220 and the first pointed end 228 or the second pointed end 230 of each of the plurality of grooves 222 lies in any other suitable range of the like.

The first groove area section 224 and the second groove area section 226 area characterized by a second circumferential arc length 208. The second circumferential arc length 208 refers to the circumferential length between the first pointed end 228 of the first groove area section 224 and the second pointed end 230 of the second groove area section 226. The first circumferential arc length 208 between the first pointed end 228 of first groove area section 224 and the second pointed end 230 of the second groove area section 226 lies in a range of about 2 microns to 50 microns. In an embodiment of the present disclosure, the second circumferential arc length 208 lies in any other suitable range of the like.

Referring to FIG. 1, each of the plurality of insulated conductors 200 of the telecommunication cable 100 includes the insulation layer 106. The insulation layer 106 circumferentially surrounds each of the plurality of notched conductors 104. In general, insulators are used in electrical equipment to support and separate various electrical conductors. The electric current in the plurality of notched conductor 104 cannot pass through the insulation layer 106. The insulation layer 106 provides electrical isolation for each of the plurality of notched conductors 104. The insulation layer 106 is circular in cross section along the entire length of the telecommunications cable 100. The insulation layer 106 extends substantially along the entire length of the notched conductor 104. The insulation layer 106 of each of the plurality of notched conductor 104 includes the second surface 232. The geometry of second surface 232 of the insulation layer 106 of each of the plurality of notched conductor 104 is identical. The geometry of second surface 232 of the insulation layer 106 is explained in detail in FIG. 2.

Referring to FIG. 2, the second surface 232 is the external surface of the insulation layer 106 of the insulated conductor 200. In general, second surface refers to external surface of the insulation layer 106 of each of the plurality of insulated conductor 200. The second surface 232 is circular is in cross section. The center of the circular cross section of the second surface 232 lies on the second longitudinal axis 216 of the insulated conductor 200. The second surface 232 extends substantially along the entire length of the insulated conductor 200. The second surface 232 is characterized by a second radial thickness 212. The second radial thickness 212 is the radial distance between the first surface 220 and the second surface 232. The second radial thickness 212 between the first surface 220 and the second surface 232 lies in a range of about 0.15 millimeter to 0.4 millimeter. In an embodiment of the present disclosure the second radial thickness 212 between the first surface 220 and the second surface 232 lies in any other suitable range of the like.

The second surface 232 is further characterized by a third radial thickness 214. The third radial thickness 214 is the radial distance between pointed ends of the plurality of grooves 222 and the second surface 232. The third radial thickness 214 between pointed ends of the plurality of grooves 222 and the second surface 232 lies in a range of about 160 microns to 450 microns. In an embodiment of the present disclosure the third radial thickness 214 between pointed ends of the plurality of grooves 222 and the second surface 232 lies in any other suitable range of the like. In an embodiment of the present disclosure, the second surface 232 is characterized by any other suitable parameters of the like.

The insulated conductor 200 is characterized by a first diameter 202. The first diameter 202 is distance between diametrically opposite pointed ends of the plurality of grooves 222. The first diameter 202 refers to diameter of imaginary circle passing through the tip of the pointed ends of the plurality of grooves 222. The first diameter 202 of the insulated conductor 200 lies in a range of about 0.5 millimeter to 0.65 millimeter. In an embodiment of the present disclosure, the first diameter 202 of the insulated conductor 200 lies in any other suitable range of the like. Further, the insulated conductor 200 is characterized by a second diameter D2. The second diameter 204 is diameter of the second surface 232. The second diameter 204 refers to diameter of the circular cross section of the second surface 232. The second diameter 204 of the insulated conductor 200 lies in a range of about 0.8 millimeter to 1.5 millimeter. In an embodiment of the present disclosure, the second diameter 204 of the insulated conductor 200 lies in any other suitable range of the like.

Referring to FIG. 1, each of the plurality of notched conductors 104 separately covered with the insulation layer 106, are termed as plurality of insulated conductors 200. The plurality of insulated conductors 200 extends substantially along the first longitudinal axis 102 of the telecommunication cable 100. The telecommunication cable 100 includes pairs of twisted insulated conductors 200. Two of the pluralities of insulated conductors 200 are helically twisted together in pairs. The plurality of insulated conductors 200 is helically twisted in pairs of two conductors to minimize the cross talk in the telecommunication cable 100. The plurality of insulated conductors 200 helically twisted is termed as plurality of twisted pairs of insulated conductors.

Further, the insulation layer 106 is made of high density polyethylene. In general, high density polyethylene is a polyethylene thermoplastic made from petroleum. The high density polyethylene is having a high mechanical strength and high electrical resistance. In an embodiment of the present disclosure, the insulation layer 106 is made of polypropylene. In another embodiment of the present disclosure, the insulation layer 106 is made of foamed polyethylene. In yet another embodiment of the present disclosure, the insulation layer 106 is made of fluoropolymer. In yet another embodiment of the present disclosure, the insulation layer 106 is made of combination of some or all of the certain materials. The certain materials include high density polyethylene, polypropylene, foamed polypropylene, foamed polyethylene and fluoropolymer. In yet another embodiment of the present disclosure, the insulation layer 106 is made of any other suitable material.

The telecommunication cable 100 includes the separator 108. The separator 108 lies substantially along the first longitudinal axis 102 of the telecommunication cable 100. In general, a separator separates plurality of pairs of insulated conductors from one another. The separator 108 is placed at the center of the telecommunication cable 100. The center of the separator 108 lies on the first longitudinal axis 102 of the of the telecommunication cable 100. The separator 108 separates each twisted pair of insulated conductors from the rest of the twisted pairs of insulated conductors. The separator 108 is suitably designed, such that it divides the core of the telecommunication cable 100 into plurality of separate sections of area. In an embodiment of the present disclosure, the separator 108 is of cross or plus shape. In an embodiment of the present disclosure, the separator 108 is of I shape. In another embodiment of the present disclosure, the separator 108 is of T shape. In yet another embodiment of the present disclosure, the separator 108 is of any other suitable shape.

The separator 108 divides the core of the telecommunications cable 100 into plurality of separate area sections. In an embodiment of the present disclosure the separator 108 divides the core of the telecommunications cable 100 into plurality of separate equal area sections. In another embodiment of the present disclosure, the separator 108 divides the core of the telecommunication cable 100 into plurality of separate unequal area sections. The separator is made up of low smoke zero halogen. In general, low smoke zero halogen is a type of plastic used in the wire and cable industry for improving performance of cables and wires. Low smoke zero halogen is custom compound designed to produce minimal smoke and no halogen during exposure to fire. In an embodiment of the present disclosure, the separator is made of foamed polyethylene. In another embodiment of the present disclosure, the separator is made of polythene. In yet another embodiment of the present disclosure, the separator is made of poly vinyl chloride. In yet another embodiment of the present disclosure, the separator is made of combination of some or all of the preselected materials. The preselected materials includes low smoke zero halogen, foamed polyethylene, polyethene and poly vinyl chloride. In yet another embodiment of the present disclosure, the separator is made up of any other suitable material.

The telecommunication cable 100 includes plurality of area sections 110-116. Each area of the plurality of area sections 110-116 corresponds to the area separated by the sides of the separator 108. The plurality of area sections are a first area section 110, a second area section 112, a third area section 114 and a fourth area section 116. In an embodiment of the present disclosure, the plurality of area section 110-116 corresponds to any other suitable number of area section. The first area section 110, the second area section 112, the third area section 114 and the fourth area section 116 are equal in cross sectional area. In an embodiment of the present disclosure, the pluralities of area sections 110-116 are equal in cross sectional area. In another embodiment of the present disclosure, the cross sectional area of the plurality of area section 110-116 is not equal. Each area section of the plurality of area sections 110-116 provides housing space for plurality of data transmission elements. Each area section of the plurality of area sections 110-116 includes one pair of twisted insulated conductors. In an embodiment of the present disclosure, each area section of the plurality of area sections 110-116 includes any other suitable number of pairs of twisted insulated conductors.

The insulation layer 106 of each of the plurality of insulated conductors 200 is colored. The insulation layer 106 of first insulated conductors, of the two insulated conductors in each of the plurality of area section 110-116 is of white color. The insulation layer 106 of the second insulated conductors, of the two insulated conductors in each of the plurality of area sections 110-116 is colored. The color of the insulation layer 106 of the second insulated conductors of the two insulated conductors in each of the plurality of area section 110-116 is selected from a group. The group includes blue, orange, green and brown. In an embodiment of the present disclosure, the group includes any other suitable colors.

The white colored of the insulation layer 106 of the first insulated conductors in each of the plurality of area sections 110-116 is marked with colored stripe. The color of the stripe on the insulation layer 106 of each of the first insulated conductors is same as the color of the insulation layer 106 of adjacent second insulated conductors in each of the plurality of area sections 110-116. In an embodiment of the present disclosure, the stripe on the insulation layer 106 of the first insulated conductors in each of the plurality of area sections 110-116 is of any other suitable color. The white colored insulation layer 106 of the first insulated conductors in each of the plurality of area section 110-116 is marked with color strip for the purpose of identification and differentiation.

The telecommunication cable 100 includes the cable jacket 118. The cable jacket 118 surrounds the plurality of twisted pairs of insulated conductors extending substantially along the first longitudinal axis 102 of the telecommunication cable 100. In general, jacket protects core elements of telecommunication cables from dust, water, moisture and physical damage. The cable jacket 118 is the outer layer of the telecommunication cable 100. The cable jacket 118 is the protective outer covering for the telecommunication cable 100. The cable jacket 118 provides thermal insulation and electrical insulation to the telecommunication cable 100. The cable jacket 118 provides mechanical protection to the telecommunication cable 100. The cable jacket 118 protects the telecommunication cable 100 from moisture, water, insects, abrasion, magnetic fields, radiations, and the like.

The cable jacket 118 is made of low smoke zero halogen. In an embodiment of the present disclosure, the cable jacket 118 is made of poly vinyl chloride. In another embodiment of the present disclosure, the cable jacket 118 is made of polyolefin. In yet another embodiment of the present disclosure, the cable jacket 118 is made low smoke fire retardant zero halogen. In yet another embodiment of the present disclosure, the cable jacket 118 is made of thermoplastic polyurethane. In yet another embodiment of the present disclosure, the cable jacket 118 is made of any other suitable material.

The telecommunication cable 100 includes a ripcord 120. In general, ripcord facilitates in stripping of outer jacket of telecommunications cable. The ripcords 120 facilitate stripping of the cable jacket 118. In an embodiment of the present disclosure, the telecommunication cable 100 includes one or more ripcords 120. In another embodiment of the present disclosure, the telecommunication cable 100 includes no ripcord 120. In an embodiment of the present disclosure, the ripcord 120 is made of nylon based twisted yarns. In another embodiment of the present disclosure, the ripcord 120 is made of polyester based twisted yarns. In yet another embodiment of the present disclosure the ripcord 120 is made of any other suitable material.

The telecommunication cable 100 is characterized by a third diameter. The third diameter is inner diameter of the cable jacket 118 of the telecommunications cable 100. The third diameter of the telecommunications cable 100 lies in a range of about 4 millimeter to 8 millimeter. In an embodiment of the present disclosure, the third diameter of the telecommunications cable 100 lies in any other suitable range. Further, the telecommunication cable 100 is characterized by a fourth diameter. The fourth diameter is outer diameter of the cable jacket 118 of the telecommunications cable 100. The fourth diameter of the telecommunications cable 100 lies in a range of about 5 millimeter to 9 millimeter. In an embodiment of the present disclosure, the fourth diameter of the telecommunications cable 100 lies in any other suitable range.

The present disclosure, provides numerous advantages over the prior art. The telecommunication cable 100 provides protection against alien crosstalk from surrounding cables at all frequency ranges. The telecommunications cable 100 has increased current carrying capacity. The telecommunication cable 100 consumes less material as compared to cables with round shape similar thickness electrical conductor. The telecommunication cable 100 with increased air gap enables an improvement in electrical properties. The telecommunication cable 100 has structural elements that enable improvement in overall installation efficiency. The telecommunication cable 100 increases the data transmissions speed.

The telecommunication cable 100 is a Category 6A cable. In an embodiment of the present disclosure, the telecommunication cable 100 is a Category 6 cable. In yet another embodiment of the present disclosure, the telecommunication cable 100 is a category 5e cable. In yet another embodiment of the present disclosure, the telecommunication cable 100 is a Category 7A cable. In yet another embodiment of the present disclosure, the telecommunication cable 100 is a Category 8 cable. In yet another embodiment of the present disclosure, the telecommunication cable 100 is an ethernet cable. In yet another embodiment of the present disclosure, the telecommunication cable 100 is of any other suitable type.

The foregoing descriptions of pre-defined embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

What is claimed is:

1. An insulated conductor for use in a telecommunications cable, the insulated conductor comprising:

a notched conductor extending along a first longitudinal axis of the telecommunications cable, wherein the notched conductor comprising:

a core region of the notched conductor;

a first surface of the core region, wherein a circumference of the first surface has a discontinuous circular cross section, wherein the first surface has a plurality of grooves extending radially, wherein each of the plurality of grooves is intruded up to different heights in the circumference of the discontinuous circular cross section of the first surface, and an insulation layer circumferentially surrounding the notched conductor, wherein the insulation layer has a second surface.

2. The insulated conductor as claimed in claim 1, wherein each of the plurality of grooves is defined by a first groove area section and a second groove area section, wherein the first groove area section is in continuous contact with the second groove area section.

3. The insulated conductor as claimed in claim 2, wherein at least one of the first groove area section has a first pointed end, and the second groove area section has a second pointed end.

4. The insulated conductor as claimed in claim 2, wherein the insulation layer is made of at least one of: high density polyethylene, polypropylene, foamed polyethylene, fluoropolymer.

5. The insulated conductor as claimed in claim 1, wherein at least one of:

a first circumferential arc length between two consecutive grooves of the plurality of grooves is in a range of about 0.1 millimeter to 1.5 millimeter, and a second radial thickness between the first surface and the second surface is in a range of about 0.15 millimeter to 0.4 millimeter.

6. The insulated conductor as claimed in claim 1, wherein each of the plurality of grooves is defined by a first groove area section and a second groove area section, wherein the first groove area section is in continuous contact with the second groove area section, wherein the first groove area section has a first pointed end, wherein the second groove area section has a second pointed end, wherein at least one of:

a first radial thickness between the first surface and the first pointed end or the second pointed end of the plurality of grooves is in a range of about 10 microns to 50 microns, a second circumferential arc length between the first pointed end and the second pointed end is in a range of about 2 microns to 50 microns, a third radial thickness between the second surface and the first pointed end or second pointed end is in a range of about 160 microns to 450 microns, a first diameter in a range of about 0.5 millimeters to 0.65 millimeters, wherein the first diameter is distance between diametrically opposite pointed ends of the plurality of grooves, a second diameter in a range of about 0.8 millimeters to 1.5 millimeters, wherein a second diameter is diameter of the second surface.

7. The insulated conductor as claimed in claim 1, wherein the plurality of grooves arranged around the first surface of the notched conductor is between 3 to 12.

8. The insulated conductor as claimed in claim 1, wherein at least one of:

the plurality grooves are distributed uniformly around the first surface, the plurality of grooves are identical in cross section along the entire length of the insulated conductor, a distance between two consecutive grooves of the plurality of grooves is identical.

9. The insulated conductor as claimed in claim 1, wherein each of the plurality of grooves has a cross-sectional shape selected from a group comprising an M-shape, sinusoidal, semicircular, square, rectangular, triangular, trapezoidal, and arched shape.

10. A telecommunications cable comprising:

a plurality of twisted pairs of insulated conductors extending along a first longitudinal axis passing through a geometrical center of the telecommunications cable, wherein each of the plurality of twisted pairs of insulated conductors comprising:

a plurality of insulated conductors, wherein each of the plurality of insulated conductor comprising:

a notched conductor extending along the first longitudinal axis of the telecommunications cable, wherein the notched conductor comprising:

a core region of the notched conductor;

a first surface surrounding the core region of the notched conductor, wherein a circumference of the first surface is of discontinuous circular cross section, wherein the first surface has a plurality of grooves extending radially inward towards a second longitudinal axis of the insulated conductor, wherein each of the plurality of grooves is intruded up to different heights in the circumference of the discontinuous circular cross section of the first surface; and an insulation layer circumferentially surrounding the notched conductor, at least one separator for separating each twisted pair of insulated conductor of the plurality of twisted pairs of insulated conductors, wherein the separator extends along the first longitudinal axis of the telecommunications cable; and a cable jacket extending along the first longitudinal axis of the telecommunications cable, wherein the cable jacket circumferentially surrounds a core region of the telecommunications cable.

11. The telecommunications cable as claimed in claim 10, wherein the telecommunications cable has at least one of:

a third diameter in a range of about 4 millimeters to 8 millimeters, and a fourth diameter in a range of about 5 millimeters to 9 millimeters.

12. The telecommunications cable as claimed in claim 10, wherein each of the plurality of grooves is defined by a first groove area section and a second groove area section, wherein the first groove area section is in continuous contact with the second groove area section.

13. The telecommunications cable as claimed in claim 10, wherein each of the plurality of grooves is defined by a first groove area section and a second groove area section, wherein the first groove area section is in continuous contact with the second groove area section, and wherein at least one of the first groove area section has a first pointed end, and the second groove area section has a second pointed end.

14. The telecommunications cable as claimed in claim 10, wherein at least one of:

a first circumferential arc length between two consecutive grooves of the plurality of grooves is in a range of about 0.1 millimeter to 1.5 millimeter, a second radial thickness between the first surface and the second surface is in a range of about 0.15 millimeter to 0.4 millimeter.

15. The telecommunications cable as claimed in claim 10, wherein each of the plurality of grooves is defined by a first groove area section and a second groove area section, wherein the first groove area section is in continuous contact with the second groove area section, wherein the first groove area section has a first pointed end, wherein the second groove area section has a second pointed end, wherein at least one of:

a first radial thickness between the first surface and the first pointed end or the second pointed end of the plurality of grooves is in a range of about 10 microns to 50 microns, a second circumferential arc length between the first pointed end and the second pointed end is in a range of about 2 microns to 50 microns, a third radial thickness between the second surface and the first pointed end or second pointed end is in a range of about 160 microns to 450 microns, a first diameter in a range of about 0.5 millimeters to 0.65 millimeters, wherein the first diameter is distance between diametrically opposite pointed ends of the plurality of grooves, and a second diameter in a range of about 0.8 millimeters to 1.5 millimeters, wherein a second diameter is diameter of the second surface.

16. The telecommunications cable as claimed in claim 10, wherein the plurality of grooves arranged around the first surface of the notched conductor is between 3 to 12.

17. The telecommunications cable as claimed in claim 10, wherein at least one of:

the plurality grooves are distributed uniformly around the first surface, the plurality of grooves are identical in cross section along the entire length of the insulated conductor, a distance between two consecutive grooves of the plurality of grooves is identical.

18. The telecommunications cable as claimed in claim 10, wherein each of the plurality of grooves has a cross-sectional shape selected from a group comprising an M-shape, sinusoidal, semi-circular, square, rectangular, triangular, trapezoidal, and arched shape.

19. The telecommunications cable as claimed in claim 10, wherein at least one of the insulation layers is made of at least one of: high density polyethylene, polypropylene, foamed polyethylene, fluoropolymer, the separator is made of a material selected from a group consisting of foamed polyolefin, polyolefin, solid or foamed polypropylene, LSZH and flame retardant polyvinyl chloride.

20. The telecommunications cable as claimed in claim 10, further comprising a ripcord placed inside the core of the telecommunications cable and lying along the first longitudinal axis of the telecommunications cable, wherein the ripcords facilitate stripping of the cable jacket.

* * * * *